US010858859B2

(12) United States Patent
Li

(10) Patent No.: US 10,858,859 B2
(45) Date of Patent: Dec. 8, 2020

(54) DOOR LATCH AND A DISHWASHER MOUNTED WITH THE DOOR LATCH

(71) Applicant: ILLINOIS TOOL WORKS INC., Glenview, IL (US)

(72) Inventor: Song Li, Dongguan (CN)

(73) Assignee: ILLINOIS TOOL WORKS INC., Glenview, IL (US)

( * ) Notice: Subject to any disclaimer, the term of this patent is extended or adjusted under 35 U.S.C. 154(b) by 1351 days.

(21) Appl. No.: 14/449,003

(22) Filed: Jul. 31, 2014

(65) Prior Publication Data

US 2015/0035295 A1 Feb. 5, 2015

(30) Foreign Application Priority Data

Jul. 31, 2013 (CN) ..... 2013 1 0330436
Jan. 7, 2014 (CN) ..... 2014 1 0006665

(51) Int. Cl.

| | |
|---|---|
| ***E05B 15/02*** | (2006.01) |
| ***A47L 15/42*** | (2006.01) |
| ***E05C 3/26*** | (2006.01) |
| ***E05C 3/22*** | (2006.01) |
| ***E05C 3/12*** | (2006.01) |

(Continued)

(52) U.S. Cl.

CPC ..... *E05B 15/029* (2013.01); *A47L 15/4259* (2013.01); *E05B 15/04* (2013.01); *E05B 17/0037* (2013.01); *E05C 3/008* (2013.01); *E05C 3/12* (2013.01); *E05C 3/22* (2013.01); *E05C 3/26* (2013.01); *Y10S 292/69* (2013.01);

(Continued)

(58) Field of Classification Search

CPC ..... Y10S 292/69; Y10T 292/1051; Y10T 292/1052; Y10T 292/1061; E05B 15/04; E05B 17/0037; E05B 15/029; E05C 3/12; E05C 3/22; E05C 3/26; E05C 3/008

USPC ..... 292/219, 220, 228, DIG. 69

See application file for complete search history.

(56) References Cited

U.S. PATENT DOCUMENTS 391,682 A * 10/1888 Brohard ..... E05B 65/0852 292/219
392,688 A * 11/1888 Purviance et al. ..... E05C 3/14 292/228

(Continued)

FOREIGN PATENT DOCUMENTS

CN 1778251 A 5/2006
CN 102525371 A 7/2012

(Continued)

*Primary Examiner* — Kristina R Fulton
*Assistant Examiner* — Faria F Ahmad
(74) *Attorney, Agent, or Firm* — Pilloff Passino & Cosenza LLP; Martin J. Cosenza

(57) ABSTRACT

A door latch and a dishwasher fitted with a door latch are described. The door latch has a body, a pawl provided with a rotating shaft, a first gap being provided between two ends of the rotating shaft, and a mounting slot being provided in one side of the pawl, a first pin mounted on the pawl, the first pin being mounted in the mounting slot in the pawl, a spring having two ends which are connected to the body and the pawl, respectively, a first end of the spring being connected to the first pin through the first gap. During installation of the door latch, assembly of the door latch is quick and easy because the first pin is put into the pin mounting slot in the pawl from the top side of the pin mounting slot, and repair with changing of components is also easy.

13 Claims, 11 Drawing Sheets

(51) Int. Cl.
*E05B 17/00* (2006.01)
*E05C 3/00* (2006.01)
*E05B 15/04* (2006.01)

(52) U.S. Cl.
CPC .... *Y10T 292/1051* (2015.04); *Y10T 292/1052* (2015.04); *Y10T 292/1061* (2015.04)

(56) References Cited

U.S. PATENT DOCUMENTS 433,848 A * 8/1890 Brohard ..... E05C 3/14 292/228
6,390,518 B1 * 5/2002 Elick ..... A47L 15/4259 292/117
7,552,738 B2 * 6/2009 Shin ..... A47L 15/4259 134/57 DL
7,775,565 B2 * 8/2010 Hartmann ..... A47L 15/4259 292/216
2012/0126552 A1 * 5/2012 Ala ..... E05C 19/024 292/228
2013/0234578 A1 * 9/2013 Ala ..... A47L 15/4259 312/326

FOREIGN PATENT DOCUMENTS

CN 103006158 A 4/2013
DE 19837248 A1 2/2000
DE 102011075554 A1 * 11/2012 ..... A47L 15/4259
EP 0917853 A1 * 5/1999 ..... A47L 15/4259
EP 1304436 A2 * 4/2003 ..... D06F 39/14
EP 1333230 A2 * 8/2003 ..... E05B 15/101
EP 1433893 A2 * 6/2004 ..... D06F 37/42
FR 374583 A * 6/1907 ..... E05C 3/12
FR 2435115 A1 * 3/1980 ..... A47L 15/4259
WO WO 2008096222 A2 * 8/2008 ..... A47L 15/4259

* cited by examiner

DOOR LATCH AND A DISHWASHER MOUNTED WITH THE DOOR LATCH

RELATED APPLICATIONS

The present application claims priority to Chinese Application Number 201310330436.2 filed Jul. 31, 2013 and Chinese Application Number 201410006665.3 filed Jan. 7, 2014, the disclosures of which are hereby incorporated by reference herein in their entirety.

TECHNICAL FIELD

The present invention relates to a door latch of an electrical appliance, in particular to a dishwasher door latch.

BACKGROUND ART

A dishwasher is an electrical appliance which washes tableware placed therein with washing water. A dishwasher generally has a front door, the bottom end of which is pivotably mounted at the bottom end of the front portion of the dishwasher, so that the front door can open and close by pivoting up and down.

A door latch for the front door is usually installed at the top end of the front door on the inner side (the side facing the main body of the dishwasher), the door latch engaging with a door hook (striker), which is fixed at the top end of the front portion of the dishwasher chamber in a position aligned with the door latch. The other parts of the door latch are all enclosed within the front door, but in order to allow the door hook to enter and withdraw, a through hole in the door latch is exposed. The door latch is generally provided with a rotatable pawl behind the through hole, with a latch hook and latch slot being provided on the pawl to engage with the door hook, so that when the front door pivots towards the dishwasher chamber and is pressed close against the same, the pawl can lock the front door; when the front door pivots in the release direction of the dishwasher chamber and leaves the dishwasher chamber, the pawl can release the front door.

When a user closes the front door, the door hook pushes the pawl to a locked position; at the same time, the pawl in the door latch rotates and triggers the switch to enter the "ON" state, so the dishwasher can start working. When the user opens the front door, the door hook pulls the pawl to the release position; at the same time, the pawl in the door latch rotates and releases the switch so that it returns to the "OFF" state, and the dishwasher stops working.

Therefore, there is a need to provide a door latch with a structure which facilitates the fitting together of components.

There is also a need to provide a door latch with a structure capable of reducing production costs.

There is also a need to provide a door latch with a structure capable of avoiding or reducing component wear, to prolong service life.

There is also a need to provide a door lock with a structure capable of improving the stable mounting relationship among components.

There is also a need to provide a door lock with a structure capable of ensuring more precise and stable operation of the trigger switch in the door latch.

CONTENT OF THE INVENTION

An object of the present invention is to provide a door latch with a structure which facilitates the fitting together of components.

Another object of the present invention is to provide a door latch with a structure capable of reducing production costs.

Another object of the present invention is to provide a door latch with a structure capable of avoiding or reducing component wear.

Another object of the present invention is to provide a door lock with a structure capable of improving the stable mounting relationship among components.

Another object of the present invention is to provide a door lock with a structure capable of ensuring more precise and stable operation of the trigger switch in the door latch.

To achieve these objects, the present invention relates to a door latch comprising:

- a body;
- a pawl provided with a rotating shaft, a first gap being provided between two ends of the rotating shaft, and a mounting slot being provided in one side of the pawl;
- a first pin mounted on the pawl, the first pin being mounted in the mounting slot in the pawl;
- a spring having two ends which are connected to the body and the pawl, respectively, a first end of the spring being connected to the first pin through the first gap.

In the door latch described above, the two ends of the mounting slot are provided with slot walls.

The door latch described above further comprises:

- a second pin mounted on the body;
- a second end of the spring being connected to the second pin.

One of the beneficial effects of the door latch of the present invention is that the structure thereof facilitates the fitting together of components.

Another beneficial effect of the door latch of the present invention is that the structure thereof is capable of reducing production costs.

Another beneficial effect of the door latch of the present invention is that the structure thereof is capable of avoiding or reducing component wear.

Another beneficial effect of the door latch of the present invention is that the structure thereof is capable of improving the stable mounting relationship among components.

Another beneficial effect of the door latch of the present invention is that the structure thereof is capable of ensuring more precise and stable operation of the trigger switch in the door latch.

DESCRIPTION OF THE ACCOMPANYING DRAWINGS

PARTICULAR EMBODIMENTS

Figure 1A:
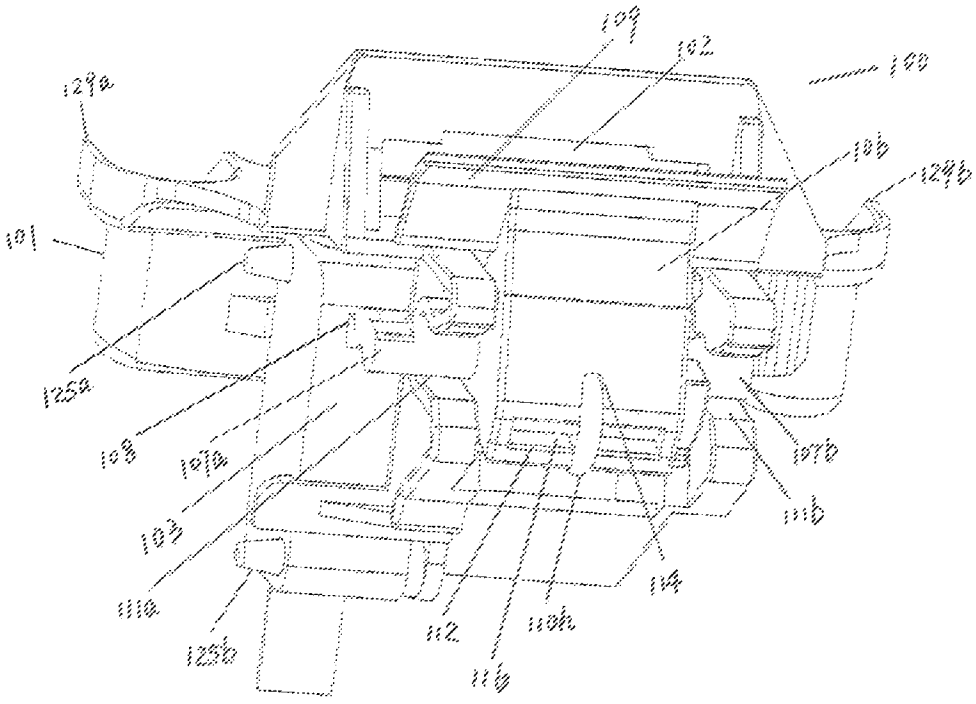
FIGS. 1A and 1B are perspective views of the front and back of the door latch 100 of the present invention, respectively.

Various particular embodiments of the present invention are described below with reference to the accompanying drawings, which form part of this description. It should be understood that although terms indicating direction such as "front", "back", "top", "bottom", "left" and "right" are used in the present invention to describe various exemplary structural parts and elements thereof, such terms are used herein solely for the purpose of facilitating explanation, and are determined according to the exemplary positions and directions shown in the drawings. Since the embodiments disclosed in the present invention can be arranged in different directions, these terms indicating direction serve a purely illustrative function and should not be regarded as restrictive. Any identical or similar labels which might be used in the present invention refer to identical parts.

Figure 1B:
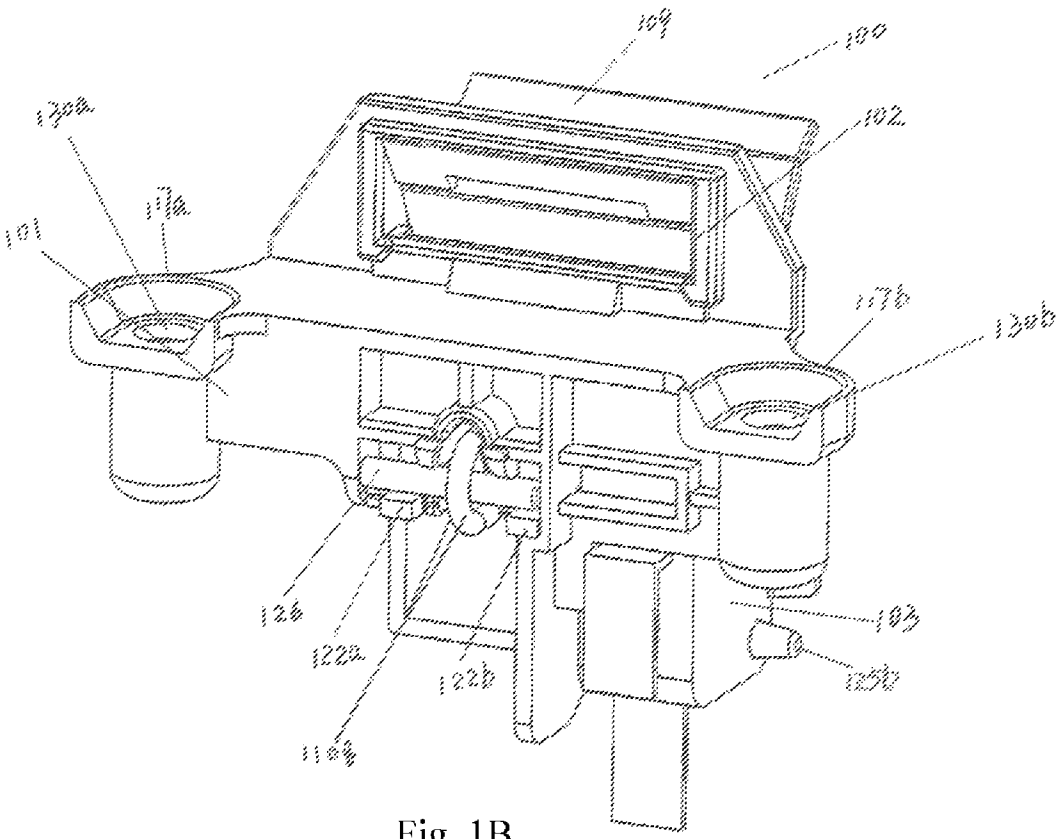

FIGS. 1A and 1B are perspective views of the front and back of the door latch 100 of the present invention, respectively. As FIG. 1A shows, the door latch 100 comprises a door lock main body 101 and a pawl 106. A trigger switch 103 is provided on one side of the door latch 100, with a trigger button 234 provided on the trigger switch 103 (see FIG. 2A). An upper portion of the door latch main body 101 is provided with a through hole 102 and a pair of rotating shaft mounts 111*a* and 111*b* which are open to the top. A pair of rotating shafts 107 (107*a*, 107*b*) is provided on the pawl 106, the two rotating shafts 107 (107*a*, 107*b*) being fitted into the rotating shaft mounts 111*a* and 111*b*, respectively; the pawl 106 is mounted on the door latch main body 101, such that the pawl 106 is positioned behind the through hole 102. The trigger switch 103 is mounted on one side (or both sides) of the door latch main body 101 by means of a pair of assembly pins 125*a* and 125*b*. A protrusion (plunger) 108 is provided on rotating shaft 107*a* of the pawl 106, for pressing down or releasing the button 234 on the trigger switch 103 (see FIG. 2A or 2B). The door latch main body 101 is provided with fixing platforms 129*a* and 129*b*, in which are provided fixing holes 130*a* and 130*b*, respectively (see FIG. 1B), for fixing the door latch main body 101 into the inside of the dishwasher front door (see FIGS. 6-7).

As FIG. 1A further shows, an upper portion of the pawl 106 is provided with a water guard plate 109, while a pin mounting slot 112 and a spring mounting gap 114 are provided at the back thereof (close to a tail portion).

A spring pin 116 is mounted in the pin mounting slot 112, a back end 110*h* of a spring 110 extending out of the spring mounting gap 114 and being fitted round (or mounted on) the pin 116, to enable the pawl 106 to rotate relative to the latch main body 101 around the rotating shafts 107 (107*a*, 107*b*). When the pawl 106 turns towards the latch main body 101, the water guard plate 109 blocks the through hole 102, thereby keeping the washing water on the outside of the door latch 100, at which point the dishwasher is in an operational state. When the pawl 106 turns away from the latch main body 101, the water guard plate 109 leaves the through hole 102, at which point the dishwasher is in a non-operational state. It should be explained that in FIG. 1A, the water guard plate 109 is not in the position where it blocks the through hole 102 in the latch main body 101, therefore the through hole 102 is visible.

As FIG. 1B shows, the upper portion of the door latch main body 101 is provided with the through hole 102, and the water guard plate 109 disposed on the pawl 106 behind the through hole 102. Pin mounts 122 (122*a* and 122*b*) are provided on the door latch main body 101, with a spring pin 126 being mounted in the pin mounts 122 (122*a* and 122*b*). A front end 110*q* of the spring 110 is fitted round spring pin 126; in other words, the front end 110*q* of the spring 110 is fitted round spring pin 126 of the door latch main body 101, while the back end 110*h* of the spring 110 is fitted round spring pin 116 on the pawl 106 (see FIG. 1A). Thus, when the dishwasher is in an operational state, the door hook 601 (see FIG. 6) is inserted in the through hole 102 and locked in the door latch 100, and the water guard plate 109 on the pawl 106 is pulled by the tension of the spring 110, such that the water guard plate 109 is held tightly against the through hole 102 in the door latch main body 101. When the dishwasher is in a non-operational state, the door latch 100 releases the door hook 601, so that the hook 601 can be pulled out of the through hole 102.

Figure 2A:
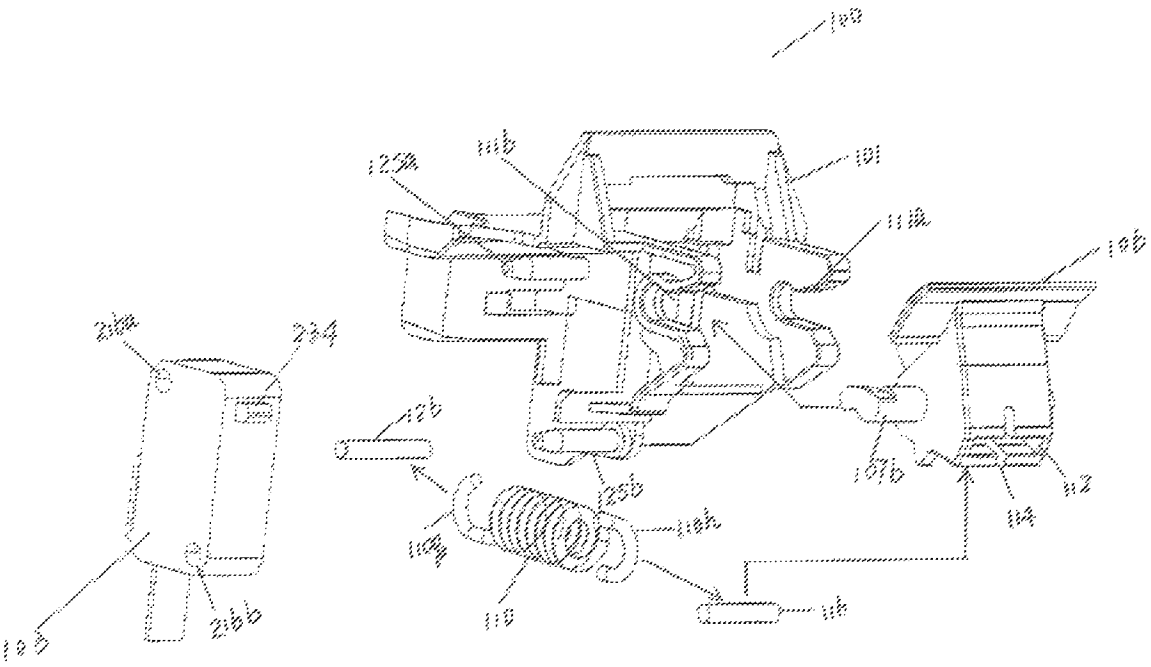
FIGS. 2A and 2B are assembly drawings of the door latch 100 of the present invention, as viewed from the front and back, respectively.
Figure 2B:
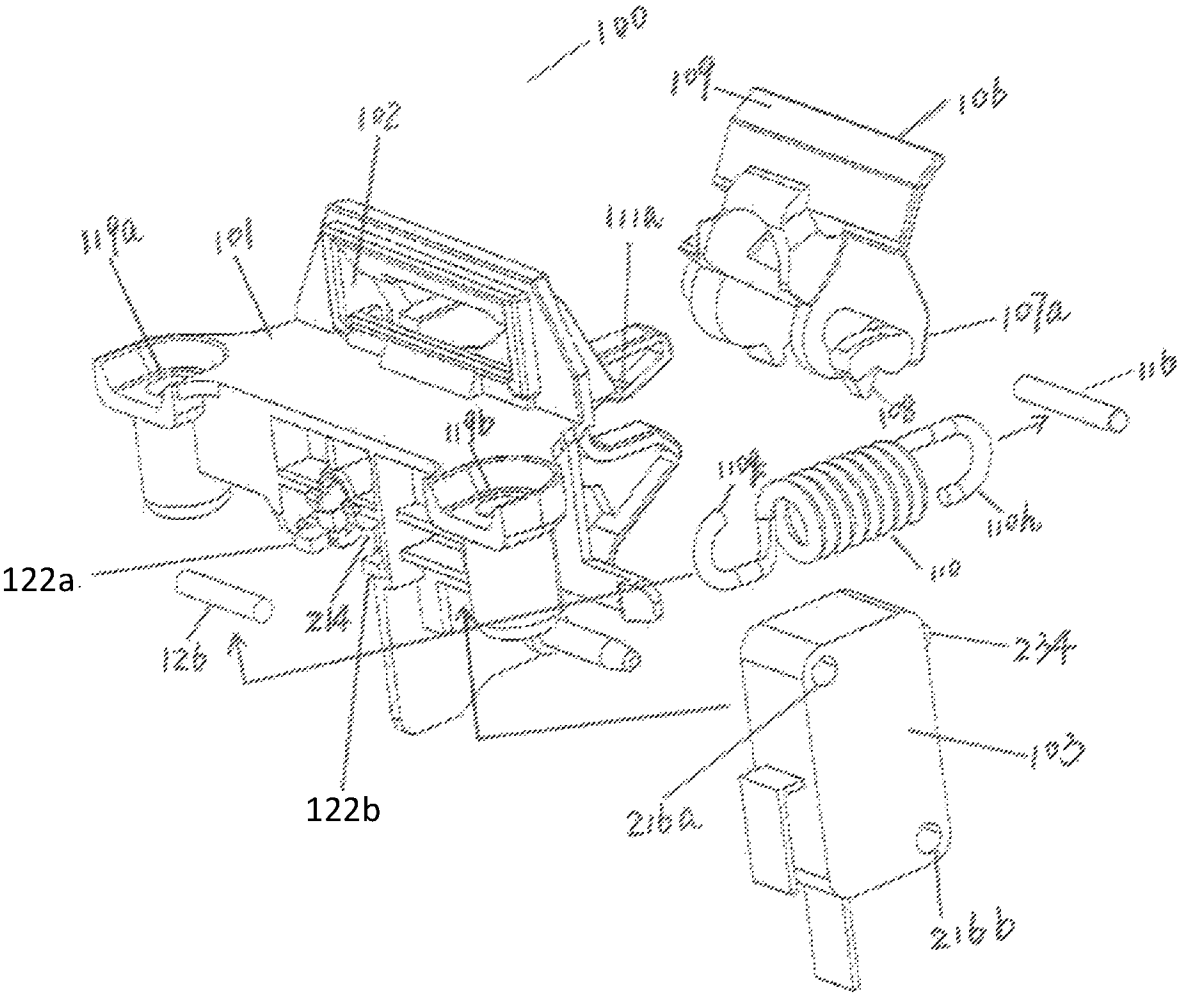

FIGS. 2A and 2B are assembly drawings of the door latch 100 of the present invention, as viewed from the front and back, respectively. As FIGS. 2A and 2B show, the back of the door latch main body 101 is provided with pin mounting platforms established by elements 122*a* and 122*b*, a gap 214 is formed between elements 122*a* and 122*b*, and the two ends of spring pin 126 are mounted on the pin mounting platforms established by elements 122*a* and 122*b*, respectively. The back end 110*h* of the spring 110 extends through the gap 114, and is fitted round (or hooked onto) spring pin 116; the front end 110*q* of the spring 110 extends through the gap 214, and is fitted round (or hooked onto) spring pin 126, thereby connecting the door latch main body 101 to the pawl 106 to form a single piece in such a way that they can rotate relative to one another. The door latch main body 101 and pawl 106 can rotate relative to one another around the rotating shafts 107 and the pin 126.

As FIGS. 2A and 2B show (see FIGS. 6-7), when the dishwasher door is opened (i.e. the dishwasher is in a non-operational state), the water guard plate 109 on the pawl 106 rotates until it is held tightly against the through hole 102, to prevent water from entering the through hole 102 when tableware is removed; at this point, the contact 234 is pressed down, and an internal switch of the trigger switch 103 is opened. When the door is closed, the door hook is inserted, making the water guard plate 109 on the pawl 106 turn away from the through hole 102, and when the contact 234 is released, the switch of the trigger switch 103 conducts, enabling the dishwasher to start operation.

It must be pointed out that in the present invention, the length of spring pin 116 is designed to be equal to or slightly shorter than the pin mounting slot 112 in the pawl 106. However, since the pawl mounting slot is disconnected in the middle, after being injection molded the two ends of the mounting slot will experience deformation in the form of contraction towards the middle, so that in fact, the size of the pin mounting slot 112 will decrease. Thus, when the pin 116 is mounted in the pin mounting slot 112, the two ends of the pin 116 hold apart the two ends of the pin mounting slot 112, enabling deformation of the pawl 106 to be prevented.

Figure 3A:
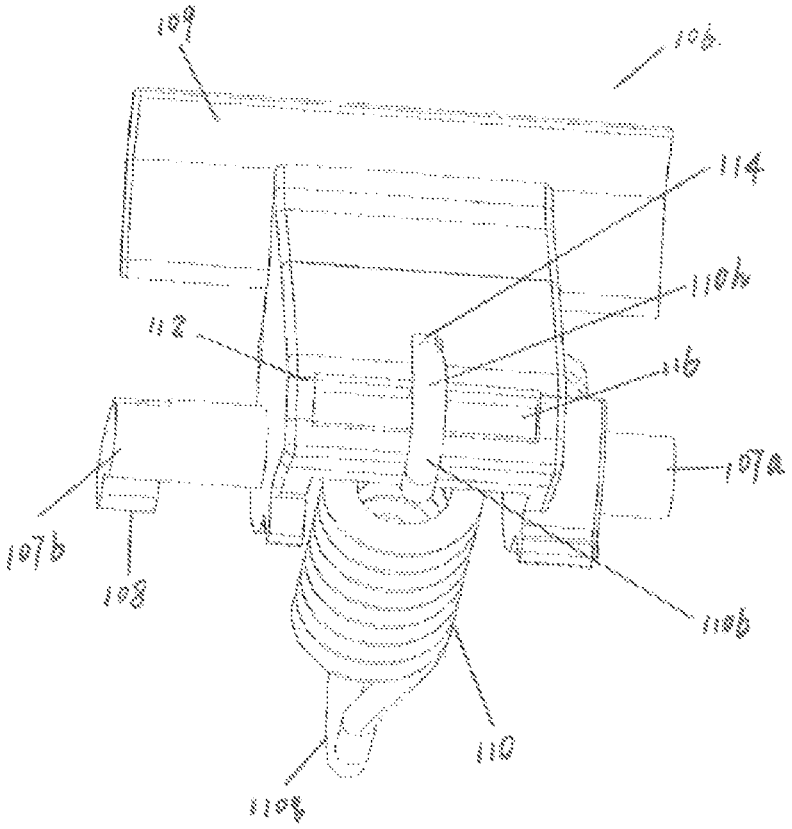
FIGS. 3A and 3B show with specifically show assembly drawings of the spring 110 and pawl 106, as viewed from the front and back, respectively.
Figure 3B:
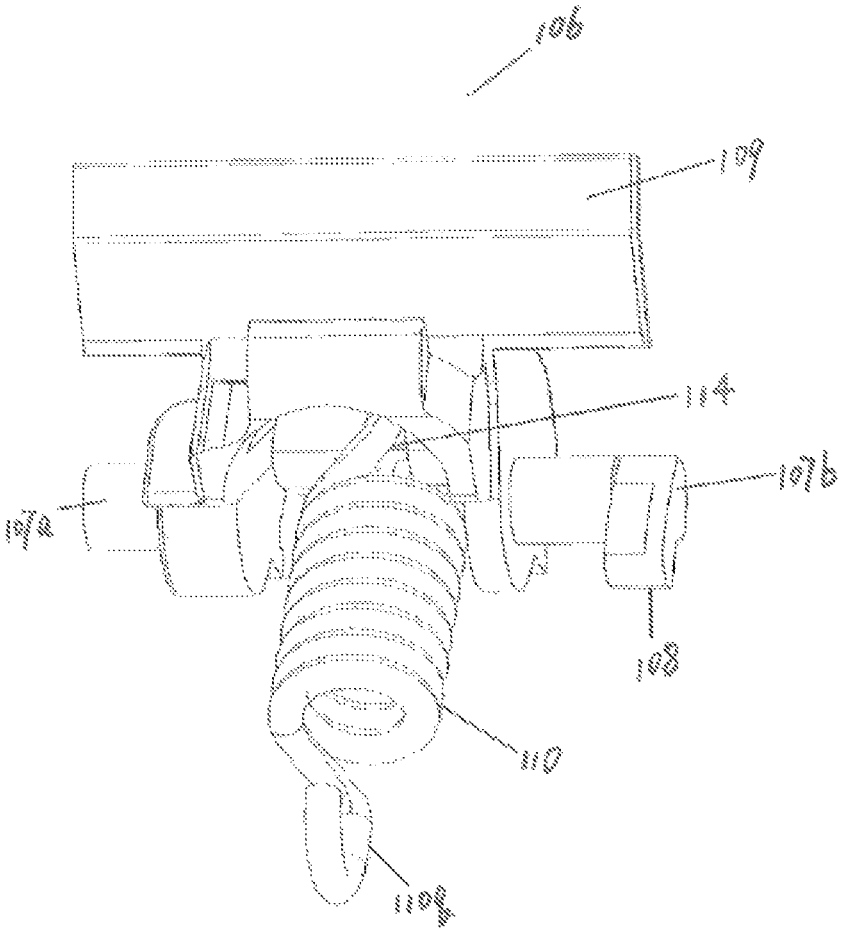

FIGS. 3A and 3B show and show in greater detail assembly drawings of the spring 110 and pawl 106, as viewed from the back and front. As FIGS. 3A and 3B show, the pin 116 is inserted into the pin mounting slot 112 in the pawl 106, and the back end 110*h* of the spring 110 extends out of the gap 114 and is hung on (or fitted round) the pin 116; the front end 110*q* of the spring 110 extends out of the gap 214 and is hung on (or fitted round) the pin 126 (see FIG. 1B).

Figure 4A:
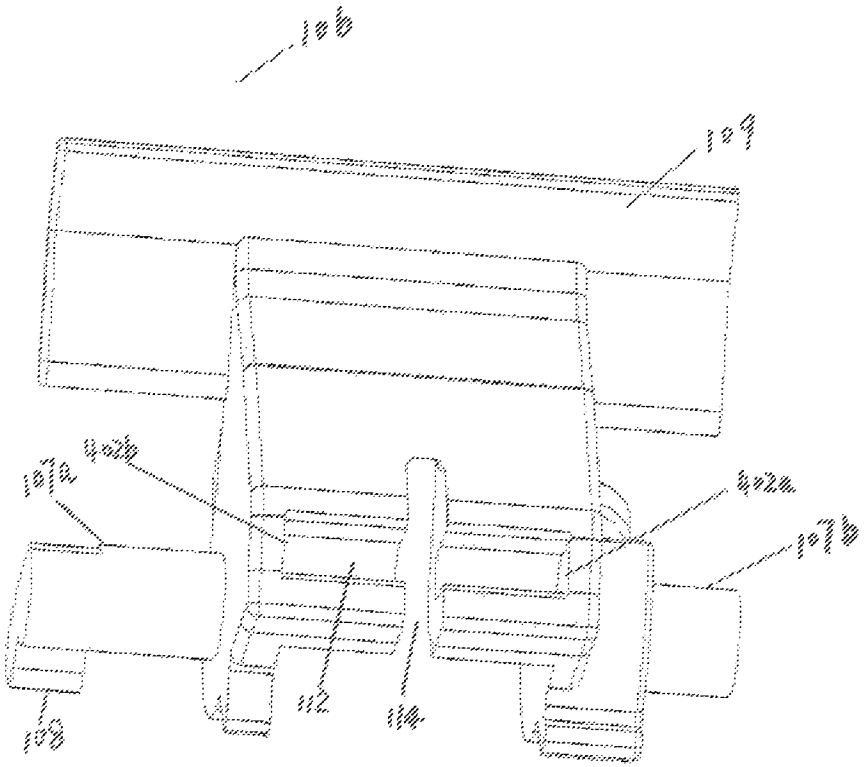
FIGS. 4A and 4B are enlarged drawings of the front and back of the pawl 106.
Figure 4B:
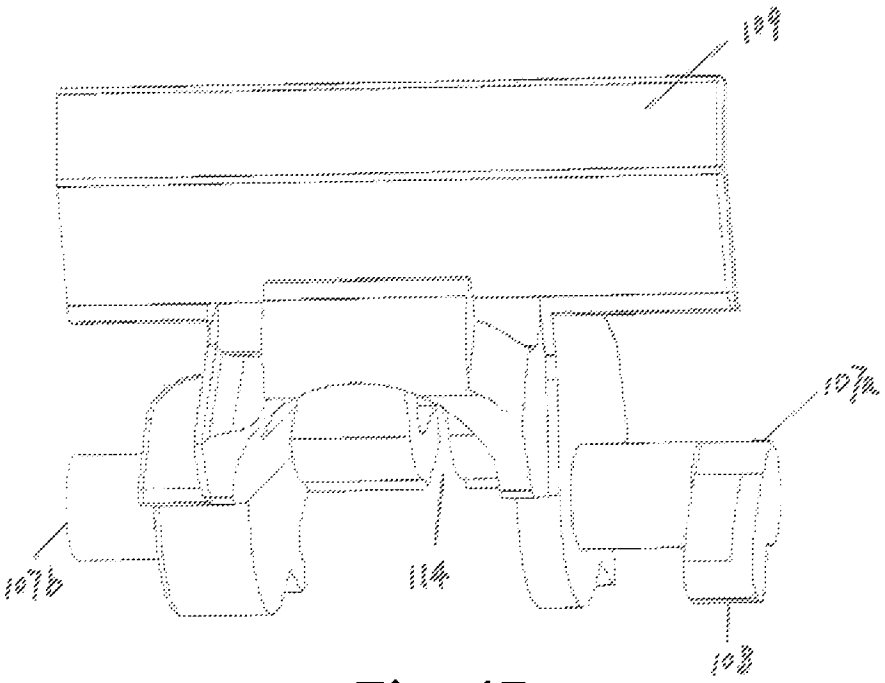

FIGS. 4A and 4B are enlarged drawings of the back and front of the pawl 106, and show the structure of the pawl 106 more clearly. As FIGS. 4A and 4B show, a tail portion of the pawl 106 is provided with the pin mounting slot 112, and slot walls (402*a*, 402*b*) are provided at two ends of the pin mounting slot 112.

Figure 5:
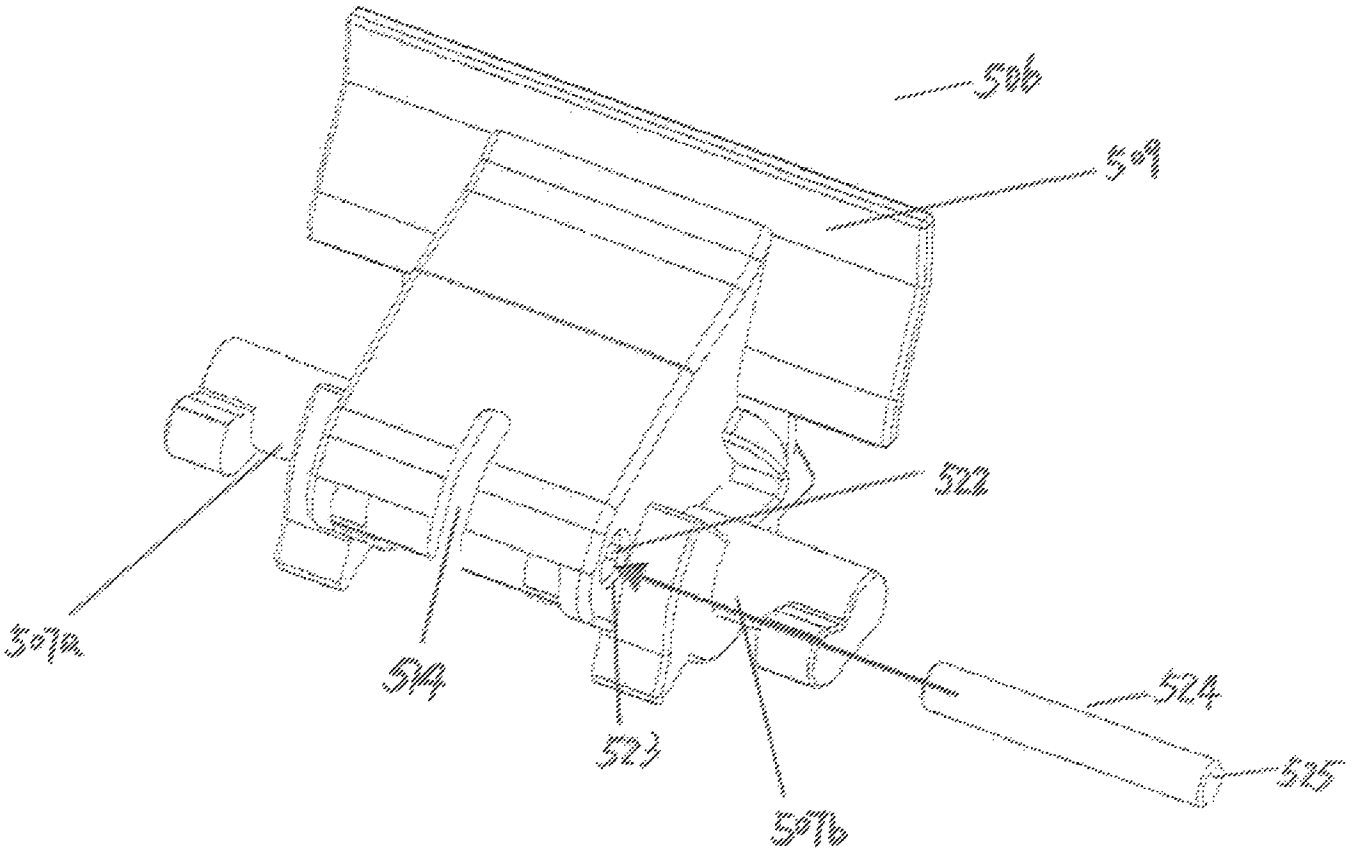
Fig. 5 (Prior Art)
FIG. 5 shows a pawl 506 in an existing door latch.

FIG. 5 shows the structure of a pawl 506 of an existing door latch. As FIG. 5 shows, an upper portion of the pawl 506 is provided with a water guard plate 509, while a tail portion thereof is provided with rotating shafts 507 (507*a*, 507*b*). A spring mounting gap 514 is provided in a middle position in the tail portion of the pawl 506, while two sides of the tail portion of the pawl 506 are provided with pin holes 522 which connect the two sides. A pin 524 is passed through the pin holes 522, and thus mounted on the tail portion of the pawl 506. It should be explained that the pawl 506 serves a similar function and has a similar effect to the pawl 106. The pawl 506 is fixed to the door latch body by means of a connecting spring, with a back end of the spring being hooked onto the pin hole 522, and a front section of the spring being fixed to the latch body. It must be noted that to facilitate mounting, the pin 524 and end portions of the pin holes 522 are provided with chamfers 525 and 523, respectively.

Figure 6:
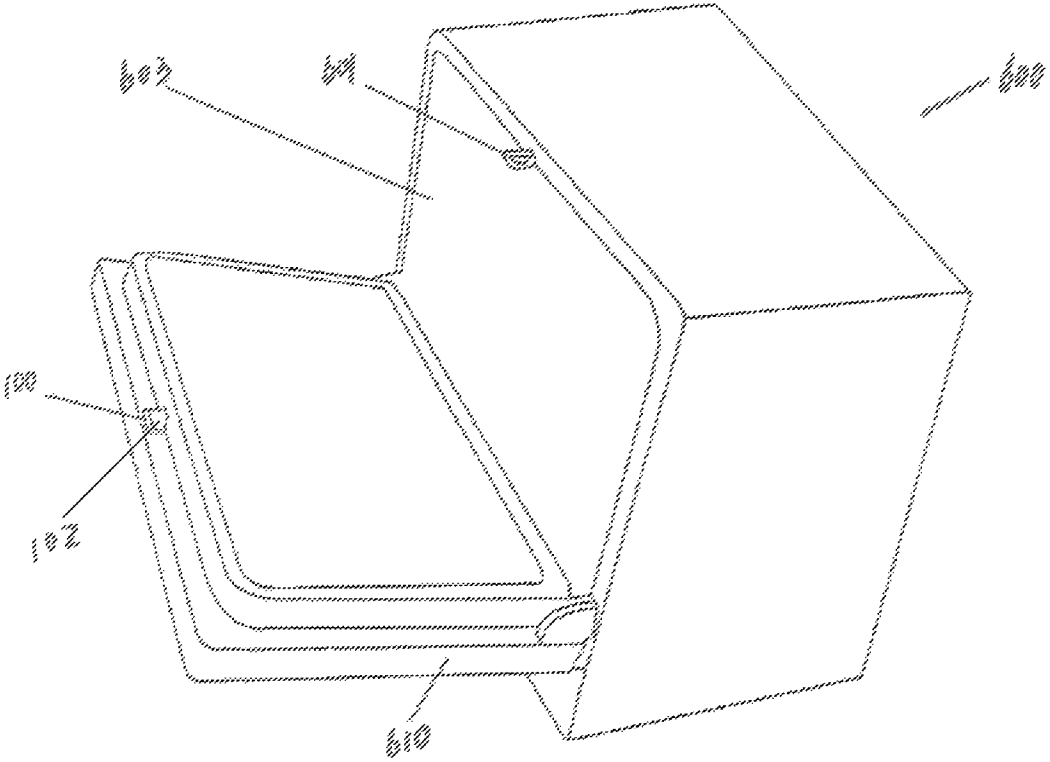
FIG. 6 shows a schematic diagram of a dishwasher 600 fitted with the door latch of the present invention.

FIG. 6 shows a schematic diagram of a dishwasher 600 fitted with the door latch of the present invention, with the door latch in an open state. As FIG. 6 shows, the bottom end of a front door 610 of the dishwasher 600 is pivotably mounted on a lower part of the dishwasher. The dishwasher front door 610 is opened to an angle of about 90°(i.e. a fully open state), the door latch 100 is mounted in the front door 610 which opens the dishwasher, with the through hole 102 alone being exposed and directed substantially upwards, and the door hook 601 (striker) is mounted above a washing chamber 603. In the present invention, the door latch being in an open state refers to the state of the door latch when the door is open; in FIG. 6, the plunger 108 of the rotating shaft 107*a* leaves the contact 234 of the trigger switch 103, triggering switch 103 to open.

Figure 7:
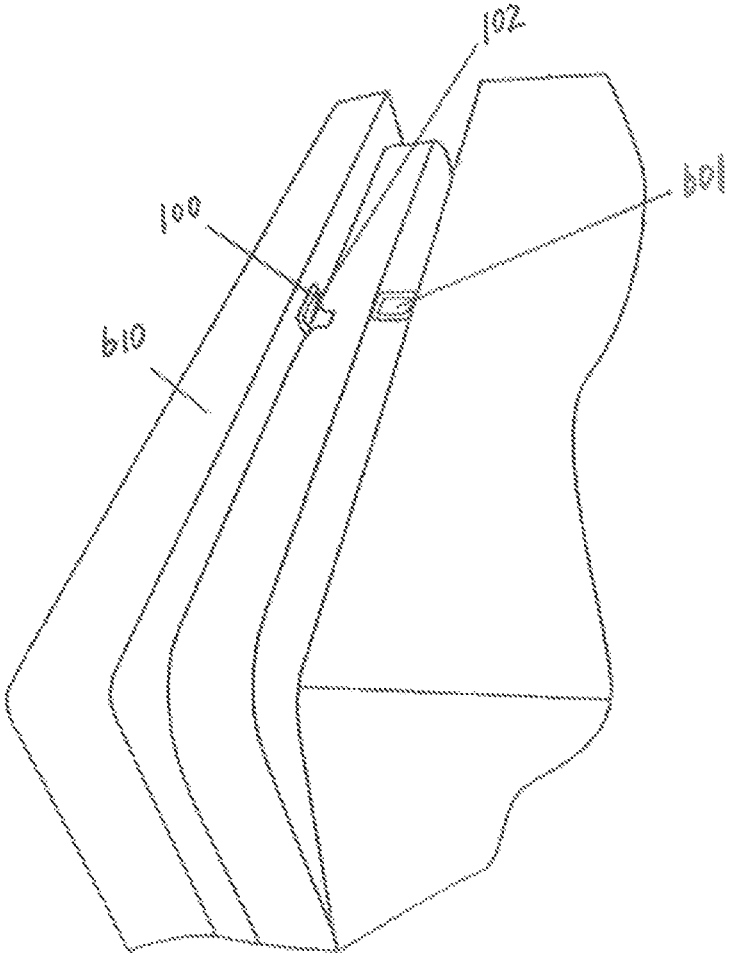
FIG. 7 is a schematic diagram of the top end of the dishwasher front door 610 in FIG. 6 and the front portion of the dishwasher 600 when the front door is nearly closed.

FIG. 7 is a schematic diagram of the top end of the dishwasher front door 610 in FIG. 6 and the front portion of the dishwasher when the front door is nearly closed. As FIG. 7 shows, when the front door 610 pivots upwards to a nearly closed position, the through hole 102 is substantially directed forwards, and is in a position substantially aligned with the door hook 601 mounted on the dishwasher. When the front door 610 is closed, the door hook 601 enters the through hole 102 from the front of the through hole, and pushes the water guard plate 109 of the pawl 106; the plunger 108 of the rotating shaft 107*a* rotates with the pawl 106, and presses the contact 234 on the trigger switch 103, the trigger switch 103 conducts, and the door latch is in a closed state.

The structure of the present invention comprises the following beneficial technical effects:

(1) During installation, assembly is quick and easy because the pin 116 is put into the pin mounting slot 112 in the pawl 106 from the top side of the pin mounting slot 112; repair and with changing of components is also easy.

(2) During installation, since the pin 116 is put into the pin mounting slot 112 in the pawl 106 from the top side of the pin mounting slot 112, rather than being passed through pin holes, there is no need for the two ends of the pin 116 to be chamfered; thus the number of processing steps are reduced, saving processing costs.

(3) During use, the two ends of the pin mounting slot 112 in the present invention are provided with slot walls, forming a mounting slot which is closed at both ends; therefore the two ends of the pin mounting slot 112 press against the two ends of the pin 116, preventing the pawl 106 from squeezing the slot 114 from the two ends towards the middle and thereby being deformed, ensuring the concentricity of the rotating shafts 107 (107*a*, 107*b*) during use, avoiding abnormal wear, and prolonging the service life. Furthermore, owing to the fact that the body 101 and pawl 106 can be made of plastics material, the gap 114 in the pawl 106 is easily deformed due to the nature of plastics material. The structure of the present invention enables the nature of plastics material in having insufficient rigidity to be remedied.

(4) During use, one side of the pin 116 abuts the bottom of the pin mounting slot 112, while the two ends of the pin 116 abut the two ends of the pin mounting slot 112; the other side of the pin 116 is pulled by the back end 110*h* of the spring 110 towards the bottom of the pin mounting slot 112, so that the pin 116 and pawl 106 are joined compactly to form a single piece. Even after a long period of use, the pin 116 will not slide out of the pawl 106 from either side of the pin mounting slot 112, ensuring that the stable mounting relationship among components is entered, to reduce the incidence of faults during use.

(5) During use, owing to the provision of the protrusion 108 on one end 107*a* of the rotating shafts 107 for the purpose of pressing down or releasing the button 214 on the trigger switch 103, the structure of the present invention is capable of preventing deformation of the rotating shafts 107 (107*a*, 107*b*), thereby ensuring that the protrusion 108 on the rotating shaft 107 operates the button 214 on the trigger switch 103 more precisely and stably.

(6) The inventor has found in the course of a long period of observation and research that in existing door latches, the pawl thereof is provided with pin holes, and a spring fixing pin is passed through the traditional pin holes, to mount the pawl on the door latch body. Therefore, during use, deformation which arises due to the existence of a gap in the pawl may result in lateral movement (or sliding) of the spring fixing pin, causing the spring fixing pin to partially slide out of one side of the pin hole. The structure of the pawl 106 of the present invention can avoid such lateral sliding of the fixing pin caused by deformation.

Although the present invention will be described with reference to the particular embodiments shown in the accompanying drawings, it should be understood that many variant forms of the door latch of the present invention are also possible, without deviating from the spirit and scope of the teaching of the present invention. The various components in the different particular embodiments of the present invention could be exchanged with each other and recombined, without violating the spirit and invention of the teaching of the present invention, and any door latch thus obtained would similarly fall within the scope of protection of the present invention. Those skilled in the art will also realize that there are different ways of changing parameters of the disclosed embodiments, such as size, shape, or type of material or elements, and these would all fall within the spirit and scope of the present invention and the claims.

The invention claimed is:

1. A door latch comprising:

a body;

a pawl provided with a rotating shaft, a first gap is provided between two ends of the rotating shaft, and a mounting slot is provided in one side of the pawl;

a first pin assembled in the pawl, the first pin is assembled in the mounting slot of the pawl; and a spring having two ends which are connected to the body and the pawl, respectively, a first end of the spring is connected to the first pin through the first gap.

2. The door latch of claim 1, wherein two ends of the mounting slot are provided with slot walls.

3. The door latch of claim 2, further comprising:

a second pin assembled with the body; and a second end of the spring is connected to the second pin.

4. The door latch of claim 3, wherein the body is provided with a first pair of mounts for mounting the two ends of the rotating shaft, and the body is provided with a second pair of mounts for mounting the second pin.

5. The door latch of claim 4, wherein a second gap is provided between the two pairs of mounts, and the second end of the spring is connected to the second pin through the second gap.

6. The door latch of claim 5, further comprising:

a trigger switch mounted on the body, the trigger switch is provided with a trigger button, and one end of the rotating shaft is provided with a protrusion which presses the trigger button of the trigger switch when rotating with the rotating shaft.

7. The door latch of claim 6, wherein the body and the pawl can make rotational movement relative to each other by rotating around the rotating shaft of the pawl and the second pin of the body.

8. The door latch of claim 2, wherein the first pin is as long as or is slightly shorter than the mounting slot.

9. The door latch of claim 2, wherein the ends of the first pin are not chamfered.

10. The door latch of claim 1, wherein the pawl is made of plastic material.

11. A dishwasher including the door latch of claim 1.

12. The dishwasher of claim 11 comprising:

a front door assembled with the door latch; and a door hook assembled opposite the door latch.

13. The door latch of claim 1, wherein:

the mounting slot has a rectangular cross-section with a length greater than a width.

* * * * *